United States Patent [19]

Giulie

[11] Patent Number: 4,471,976

[45] Date of Patent: Sep. 18, 1984

[54] HEAT ACTIVATED BINDING AND FILING SYSTEM

[76] Inventor: Joe D. Giulie, P.O. Box 10101, Palo Alto, Calif. 94303

[21] Appl. No.: 290,521

[22] Filed: Aug. 6, 1981

[51] Int. Cl.[3] ..... B42D 3/00; B42D 3/04; B42D 3/02

[52] U.S. Cl. ..... 281/35; 281/36; 412/8; 412/900; 412/6

[58] Field of Search ..... 412/8, 34, 37, 900; 281/42, 35, 10, 14, 22, 15 R, 21 R, 23, 24, 21, 29; 402/75, 79, 80 P, 500

[56] References Cited

U.S. PATENT DOCUMENTS

| | | | |
|---|---|---|---|
| 462,959 | 11/1891 | Sullivan | 281/23 |
| 879,573 | 2/1908 | Neuner | 281/21 R |
| 1,802,794 | 4/1931 | Trussell | 281/35 |
| 2,523,860 | 9/1950 | Budden | 412/37 X |
| 3,437,506 | 4/1969 | Falberg | 412/8 X |
| 3,973,787 | 8/1976 | Staats et al. | 281/21 R |
| 4,129,471 | 12/1978 | Rome | 281/21 R X |
| 4,244,069 | 1/1981 | Hale | 412/900 X |
| 4,289,330 | 9/1981 | Wiermanski | 281/21 R |
| 4,371,194 | 2/1983 | Wang et al. | 281/21 R |

FOREIGN PATENT DOCUMENTS

| | | | |
|---|---|---|---|
| 993915 | 7/1976 | Canada | 281/21 R |
| 0123190 | 1/1901 | Fed. Rep. of Germany | 281/25 R |

OTHER PUBLICATIONS

Xerox Disclosure Journal vol. 4 No. 5 Sep./Oct. 1979.

*Primary Examiner*—Paul A. Bell
*Assistant Examiner*—Taylor J. Ross
*Attorney, Agent, or Firm*—Robert G. Slick

[57] ABSTRACT

A binding system is disclosed wherein a relatively narrow strip of heavy paper or the like is provided with a section having a heat sealing adhesive. Papers to be bound are placed against the heat sealable adhesive which is heated to activate the adhesive and is cooled. Various embodiments include side mounted, top mounted, hanging, and computer print out binders.

3 Claims, 10 Drawing Figures

HEAT ACTIVATED BINDING AND FILING SYSTEM

SUMMARY OF THE INVENTION

The present invention relates to a binder system which employs a relatively narrow strip of a material such as heavy cardboard which has a heat sensitive binder substance near the center thereof. Preferably the heat sensitive material is corrugated to facilitate the binding operation.

Modern offices are overwhelmed with paperwork and many methods have been proposed and used to permanently or temporarily bind papers together. Most of these systems have a number of defects.

For instance, paperclips are frequently used to bind papers together but the clips are expensive, increase the bulk of the file, and must be removed prior to shredding or other operations when it is desired to destroy the file. Further, such a binding system does not permit the papers to lie flat when it is desired to make photocopies of them.

Ring notebooks also are used but these have the disadvantage of cost and bulk and the difficulty of adding and subtracting sheets.

In accordance with the present invention, a simple, inexpensive device is employed which allows one to bind a number of sheets together. The basic structure consists of a strip of heavy paper, cardboard or plastic which is relatively narrow compared to the width of the paper to be bound and which has a thermally activated adhesive near the center thereof.

The invention can be employed in a variety of ways. Since the strip is narrow with adhesive only near the center, it is very economical.

One embodiment includes a center mounting strip which can be glued into an ordinary file folder so that the file can be opened with papers bound on one side. In another embodiment the strip is mounted at the top of the binder so that the papers can be held at the top. In either case, the papers are easy to insert and are held by the hot melt adhesive. If it is desired to photocopy the file, the papers will lie flat without the necessity of taking them apart as would be the case if they were held using staples or paperclips. The papers occupy the minimum amount of space and thus conserve file drawer space and, if it is desired to destroy the file, the whole file may be merely fed into a shredding machine.

In another aspect of the present invention, the binder can be provided with an index tab, making a low cost retainer for computer print outs or the like.

In another aspect of the invention, the strips can be employed for hanging files.

Thus, the device of the present invention is one of great versitility in that it is low in cost and can be used for various types of files and in all cases reduces the storage space requirements, reduces the labor requirements, permits one to copy selected documents without disassembling the file and reduces the misfiling of documents.

Other objects and features of the invention will be brought out in the balance of the specification.

DESCRIPTION OF THE PREFERRED EMBODIMENTS

Figure 1:
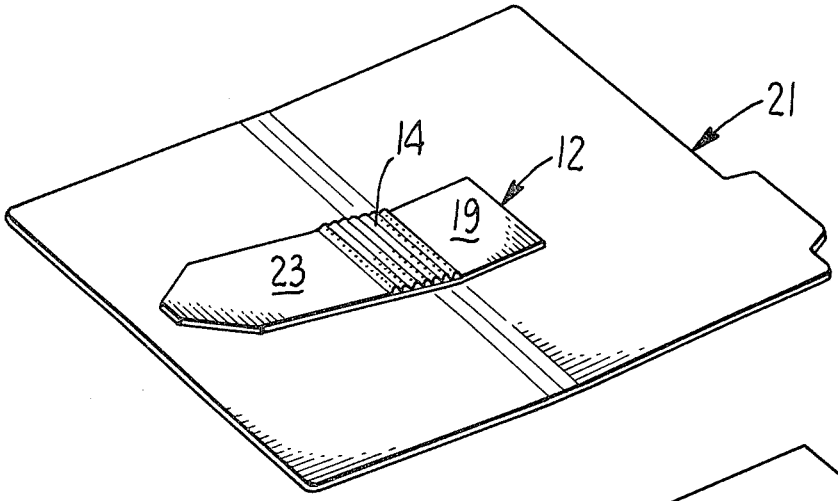
FIG. 1 is a perspective view of a file folder having a binder of the present invention incorporated therein.
Figure 2:
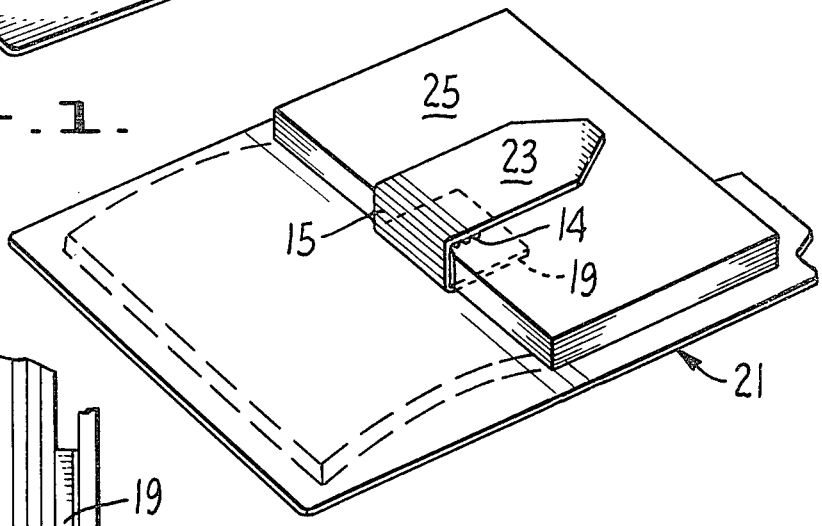
FIG. 2 is similar view showing the binder after a number of documents have been filed.

Referring now to the drawings by reference characters, and particulary FIGS. 1–4, there is shown a binder element which consists of an elongated strip generally designated 12 having an area of heat sensitive adhesive 14 intermediate to the ends. As can best be seen in FIG. 3, adhesive 14 is formed with a series of peaks 16 and valleys 17. This tends to center sheets that are placed in a folder for sealing. The binder element 12 has a short end 19 which can be fastened, as by gluing, to an ordinary file folder generally designated 21. The binder element also has a tongue portion 23. The back surface, opposite the adhesive area 14, is creased or scored as at 15 so that the strip 12 will bend most easily at the edge of a stack of papers. The score lines are placed opposite to the valleys in the adhesive as shown in FIG. 2.

Figure 3:
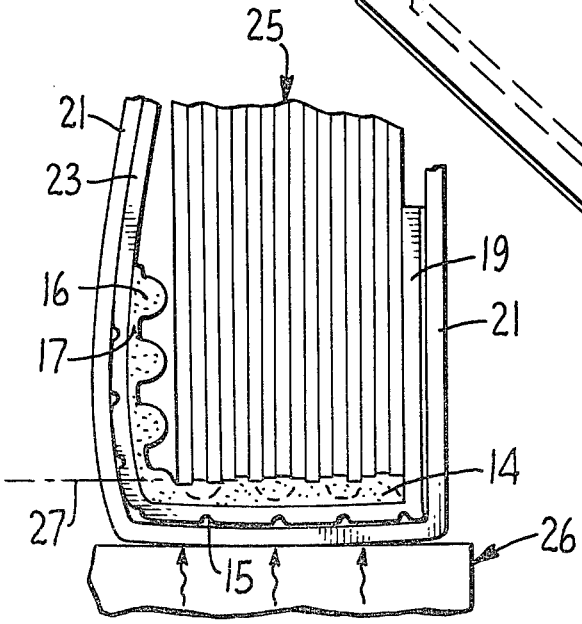
FIG. 3 is an enlarged partial end view showing how the heat sensitive binder is activated.

When it is desired to fasten papers in the file, a sheaf of papers as at 25 is placed against the heat sensitive layer 14 and the folder brought up around the sheaf as shown in FIG. 3. The end of the folder is pressed against a heat source 26 and held momentarily to soften the heat sensitive material and to cause it to adhere to the ends of the sheaf 25. It will be seen from FIG. 3 that the portion of the heat sensitive adhesive above the fold line 27 is not in contact with the heating element 25 and therefore does not become softened. This material is thus available for fastening additional papers in the file at any time. Thus, one can repeatedly fasten papers by adding papers to the sheaf already in the file and again pressing the file against the heat source. After the papers are caused to adhere the file is allowed to cool and then the file assumes the form shown in FIG. 2. The file can be opened to a desired sheet as shown in dash lines and the file will lie substantially flat.

Figure 4:
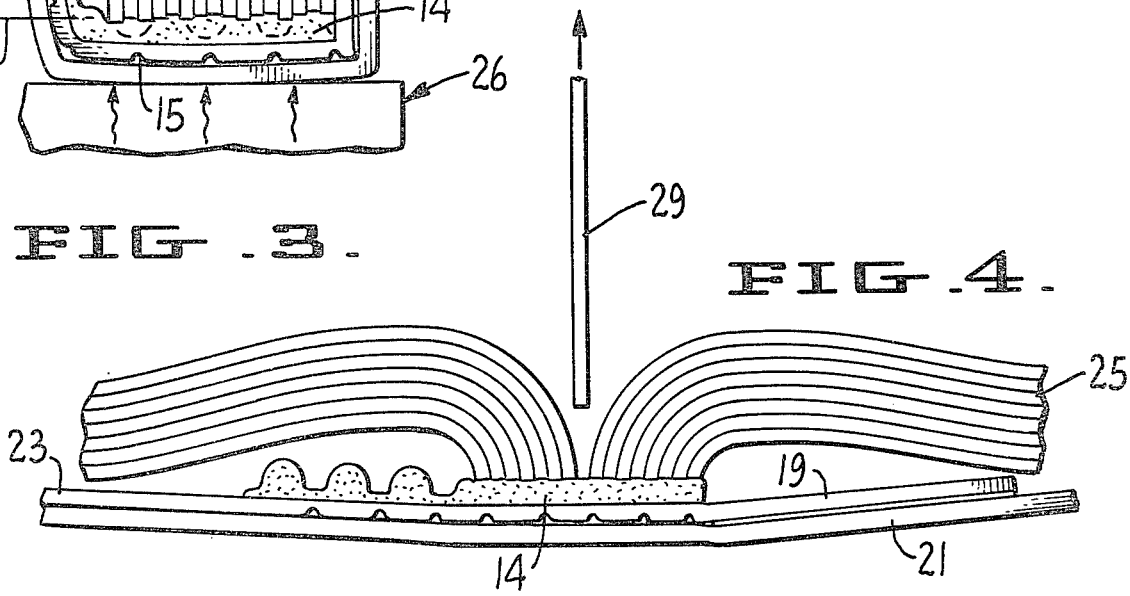
FIG. 4 is a similar end view showing how a single sheet can be withdrawn.

It will be seen that the strip 12 is considerably narrower than the paper to be fastened. Usually the retainer strip is at most $\frac{1}{4}$ to $\frac{1}{3}$ as wide as the marginal edge of the sheets to be fastened. In a practical embodiment, the strips were about 2 inches wide for letter size sheets and about 3 inches wide for legal size sheets. This is adequate to allow normal use of the files but, since the area of adhesion is relatively small, sheets can easily be removed as shown in FIG. 4. Thus, a sheet such as 29 can be pulled out in the direction shown by the arrow to detach the sheet. Obviously, the sheet can be reinserted, if desired, merely by placing it back in position and reheating as is shown in FIG. 3. Further, the sheets lie flat easily when the file is opened as the width of the adhesive is narrow compared to the page width of the bound sheets.

Figure 5:
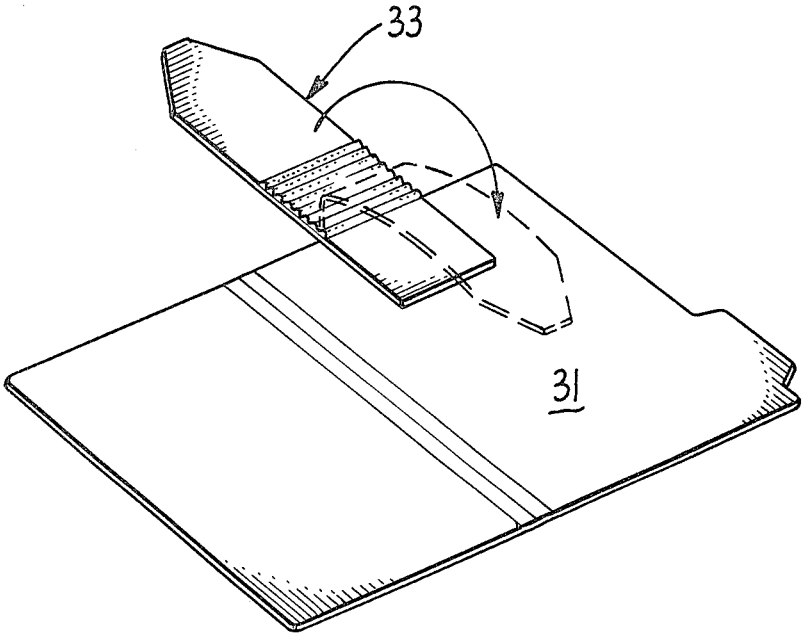
FIG. 5 is a perspective view of a file folder having a binder strip located at the top thereof.

In some instances, it is desired to retain the papers at the top rather than the side of a file and the retainer in the present invention lends itself to this as is shown in FIG. 5. Here an ordinary file folder 31 has a retainer 33 fastened at or near the top thereof. Papers are inserted and fastened in place exactly as has been described in FIGS. 1 through 3.

Figure 6:
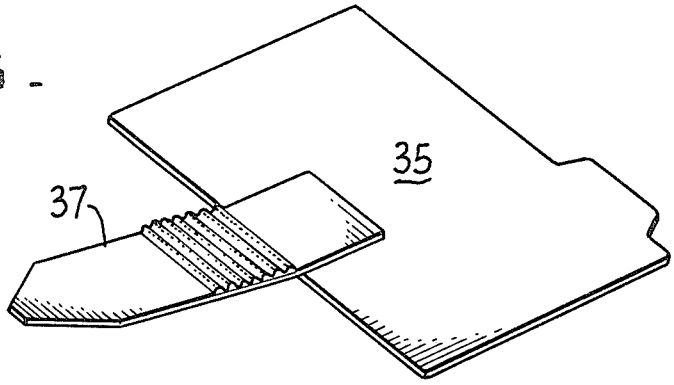
FIG. 6 is a perspective view showing how a binder strip can be used with a single backing member.

In order to conserve space, it is frequently desirable to eliminate one of the covers of the file so that the structure shown in FIG. 6 can be used. Here instead of a file folder, a single stiff sheet 35 is employed with a retainer 37 attached to one edge thereof. Obviously, the retainer 37 might be attached to the top rather than the side.

Figure 7:
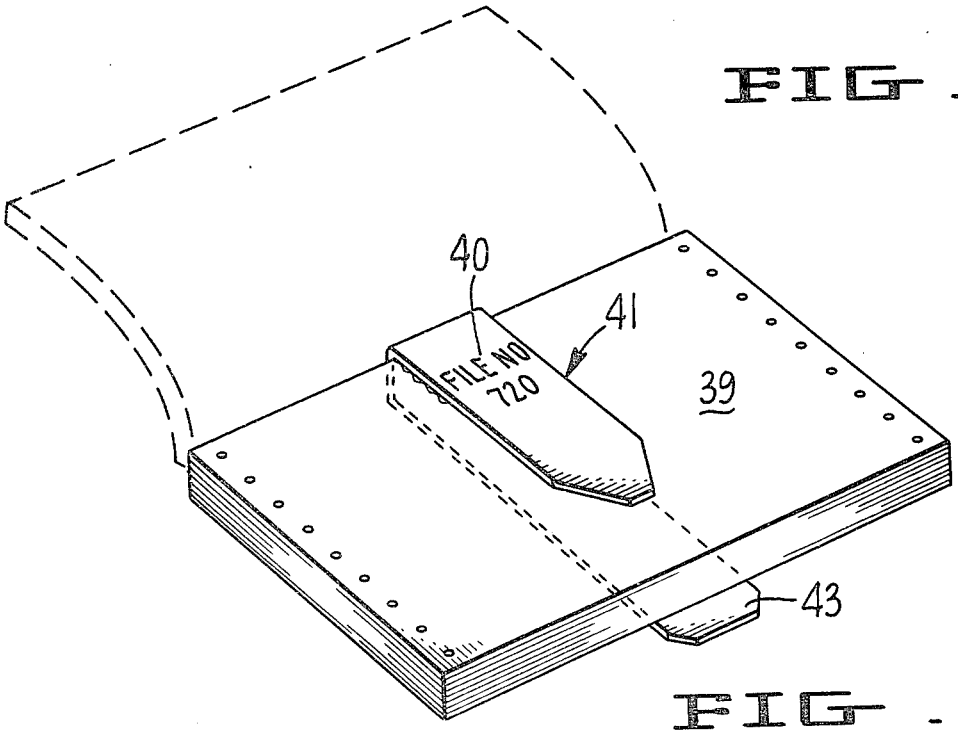
FIG. 7 is a perspective view showing the use of a binder strip not employing a file folder to hold a plurality of computer print out sheets.

Computer print outs take the form of fan fold sheets and these are ordinarily unwieldly to handle and file. The retainer of the present invention is ideally suited for this purpose since the retainer can be used to hold a stack of computer print outs together, either in the original connected fan fold form or after the sheets have been separated. At the same time, the retainer of the present invention enables one to remove one or more of the sheets as desired. Thus, referring specifically to FIG. 7 there is shown a stack of the usual computer print out sheets 39 and a retainer 41 made in accordance with the present invention holding the sheets together. In this case the retainer has an index tab 43 so that the stack of computer print outs can be identified. Also, instructions or the like can be printed on the retainer as at 40.

Figure 8:
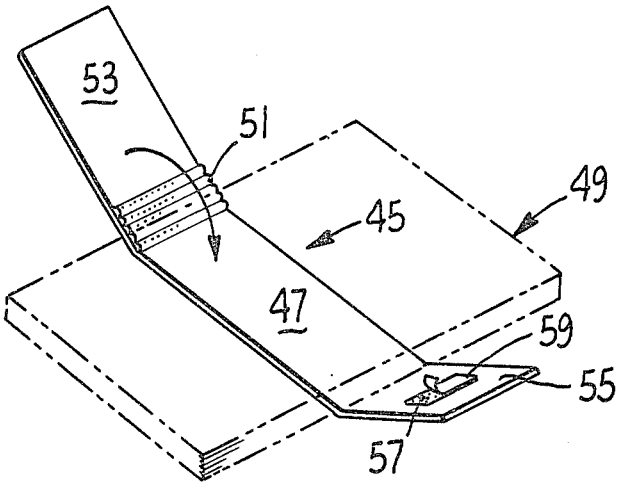
FIG. 8 illustrates a binder which incorporates a pressure sensitive tab and the strip can be folded over to hold a stack of papers.

A further elaboration of this idea is shown in FIG. 8. Here the retainer is generally designated 45 and has one length 47 which is coextensive with the width of a stack of papers 49 to be held. The retainer is provided with a heat sensitive adhesive 51 as previously described and also the retainer has two short ends 53 and 55. End 55 has a pressure sensitive adhesive 57 thereon, normally protected by the peel off paper 59. Now it is possible to adhere the stack of papers 49 to the heat sensitive layer 51 and then fold the end 53 over the stack, followed by the removal of protective paper 59 whereupon 55 will overlie the end 53 and the pressure sensitive adhesive 57 will detachably hold the stack together.

Figure 9:
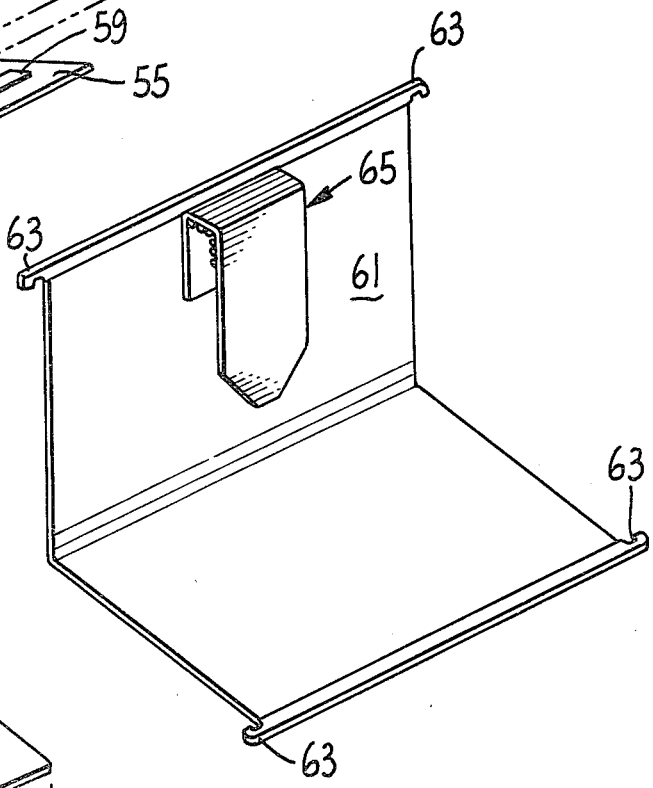
FIG. 9 illustrates how the binder system of the present invention can be used with files provided with hangers.

The retainer of the present invention is well adapted for use with hanging files wherein file folders are suspended from parallel rails within in a file drawer. Thus, referring to FIG. 9 there is shown a conventional hanging folder 61 having the usual hooks 63 so that the folder can be suspended from parallel rails within a file drawer. The retainer 65 has been glued near the top of the sides of the hanger as is shown and this may be utilized to hold the papers within the file.

Figure 10:
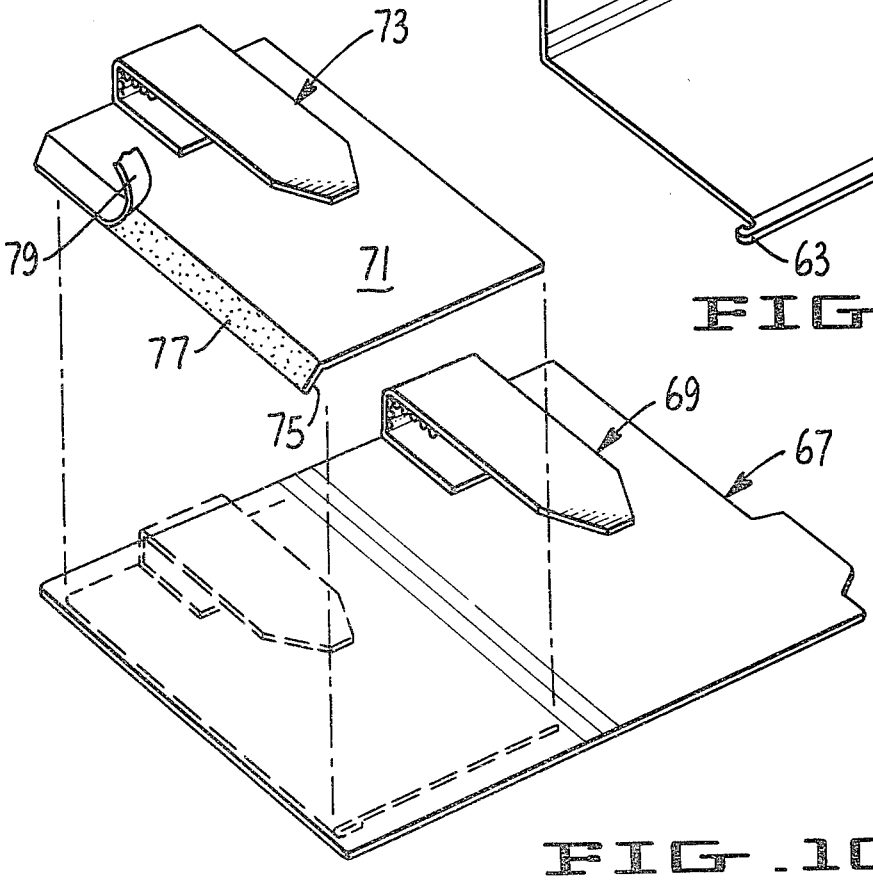
FIG. 10 illustrates how the binder system of the present invention can be employed together with a backing member having a pessure sensitive adhesive whereby the binder can be placed as an insert file folder.

FIG. 10 shows how more than one of the retainers might be used in a single file and also how the retainers might be incorporated with pressure sensitive members for addition to existing files. Here a file folder 67 is shown incorporating a retainer 69 on the right hand side. In this instance it is desired to employ a second retainer and for this purpose a separate sheet 71 having the retainer 73 attached thereto is employed. Sheet 71 has a folded over edge 75 with a pressure sensitive adhesive 77 upon the edge. The pressure sensitive adhesive is protected by the peel off strip 79. In order to assemble the file, it is only necessary to peel off the strip 79, fold the strip 75 under and then press it into contact with the folder 67 to the position shown in dash lines in FIG. 10.

Although several specific embodiments of the invention have been shown, these are merely for purposes of illustration. It will be obvious to those skilled in the art that many variations can be made from the exact structures shown without departing from the spirit of this invention.

Subject matter to be claimed is:

1. A retainer to engage only a small portion of a marginal binding edge of one or more sheets of paper, said retainer being an elongated strip having a width from about $\frac{1}{4}$ to $\frac{1}{3}$ of the length of said marginal binding edge of the papers to be secured, said retainer having first and second elongated end portions and a relatively short center portion with one surface only of said center portion being provided from edge-to-edge with a heat sensitive adhesive, said first and second elongated end portions being free of adhesive, and retainer being adapted to be applied at right angles across the marginal binding edge of the sheets of paper to be joined, leaving the major portion of the marginal binding edge free of attachment, said heat sensitive adhesive being applied in a series of transverse strips to provide an adhesive area of peaks and valleys, the retainer having a plurality of transverse score lines on a surface thereof opposite said one surface with the heat sensitive adhesive, and said score lines being formed parallel to said strips and opposite the valleys in the adhesive.

2. The retainer of claim 1 wherein the elongated strip of the retainer is made of cardboard.

3. The retainer of claim 1 wherein one of said end portions of said retainer is attached to a file folder.

* * * * *